US005876093A

United States Patent [19]

Williams

[11] Patent Number: 5,876,093

[45] Date of Patent: Mar. 2, 1999

[54] COLLAPSIBLE DESK AND CHAIR APPARATUS

[76] Inventor: Willis Ray Williams, 3129 Pinewood Dr., Arlington, Tex. 76010-0114

[21] Appl. No.: 907,876

[22] Filed: Aug. 11, 1997

Related U.S. Application Data

[63] Continuation-in-part of Ser. No. 670,027, Jun. 25, 1996, Pat. No. 5,685,602.

[51] Int. Cl.[6] ..... A47B 39/00

[52] U.S. Cl. ..... 297/174; 297/173

[58] Field of Search ..... 297/174, 173, 297/171, 170, 158.4, 156, 163, 167, 135, 440.24, 452.2, 335, 331; 108/120

[56] References Cited

U.S. PATENT DOCUMENTS 633,762 9/1899 Kade .
2,656,232 10/1953 Raphael .
2,817,170 12/1957 Skelton et al. .
3,141,424 7/1964 Seymour .
3,420,571 1/1969 Moore .
3,788,696 1/1974 Loewen .
4,884,841 12/1989 Holley .

FOREIGN PATENT DOCUMENTS 166286 7/1950 Austria .

*Primary Examiner*—Milton Nelson, Jr.
*Attorney, Agent, or Firm*—Henderson & Sturm

[57] ABSTRACT

An improved collapsible desk and reinforced chair apparatus 10 including a one piece desk member 20 having two pairs of support legs 30, 30 and 31, 31 pivotally connected thereto and to one another and a seat unit 13 pivotally connected to both the desk member 20 and one of the pairs 30, 30 of support legs. A seat reinforcement unit 14 is operatively connected between the seat unit 13 and one of the pairs 30, 30 of support legs and comprises a pair of telescoping sleeve elements 74, 75 which rotate a latch cam element 76 during the extension and retraction phases of the collapsible desk and reinforced chair apparatus 10.

6 Claims, 3 Drawing Sheets

COLLAPSIBLE DESK AND CHAIR APPARATUS

CROSS REFERENCE TO RELATED APPLICATIONS

This application is a continuation-in-part application of application Ser. No. 08/670,027 filed on Jun. 25, 1996, now U.S. Pat. No. 5,685,602, and entitled "Collapsible Desk and Chair Apparatus", the content of which is incorporated herein by reference.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of collapsible furniture in general, and in particular to an adjustable desk and reinforced chair apparatus.

2. Description of Related Art

As can be seen by reference to the following U.S. Pat. Nos. 1,514,418; 2,197,302; 3,427,069; and 4,289,350, the prior art is replete with myriad and diverse collapsible furniture devices.

While all of the aforementioned prior art constructions are more than adequate for the basic purpose and function for which they have been specifically designed, they are uniformly deficient with respect to their failure to provide a simple, efficient, and compact arrangement for a collapsible desk and chair apparatus wherein the apparatus occupies the minimum possible storage space while not in use and which is very easy to deploy in its operative mode, while also providing a very stable platform surface for both the table and chair members.

As users of the existing prior art constructions are all to painfully aware, the currently available collapsible desk and chair arrangements are difficult to assemble, require too much storage space when not in use, and are difficult to transport from one location to another.

Educators in a limited space multi-use classroom environment and parents with pre-schoolers have long realized the benefits of having a well constructed collapsible desk and reinforced chair apparatus that could be employed by adults, as well as children for work, play, eating, studying, etc.

In addition, target shooters are always looking for collapsible shooting benches having a stable support for their firearms and accessories while also providing a comfortable seating arrangement.

As a consequence of the foregoing situation, there has existed a longstanding need for a new and improved collapsible desk and reinforced chair apparatus that is simple to use, compact during storage, adapted for a variety of functional purposes, and provides extremely stable work and torso supporting surfaces for the user, and the provision of such a construction is a stated objective of the present invention.

BRIEF SUMMARY OF THE INVENTION

Briefly stated, the collapsible desk and chair apparatus that forms the basis of the present invention includes a table unit, a table support unit pivotally connected to the table unit, a seat unit pivotally connected to the table support unit, and a seat reinforcement unit operatively engaged to the seat unit and a portion of the table support unit.

As will be explained in greater detail further on in the specification, the table support unit includes two pairs of support legs that are pivotally connected to one another and comprise the primary support structure for the apparatus. One of the pairs of support legs is elongated so that they will extend a greater distance beyond the table unit such that the seat unit which is pivotally associated with the elongated pair of support legs can be spaced from the overhang of the table unit and supported by the seat reinforcement unit which extends between the seat unit and elongated pair of support legs.

Furthermore, the other pair of support legs is both slidably and pivotally associated with the track elements disposed beneath the table unit such that both pairs of support legs may be disposed into a spring biased opening movement relative to the table unit.

In addition, the apparatus is specifically designed and contoured to accommodate adjacent portions of the apparatus to produce the smallest possible apparatus profile during storage and/or transport. Furthermore, the various support arms and legs of the apparatus are spaced from one another such that they not only do not interfere with one another, but, in some instances captively surround each other to further diminish the apparatus profile.

Most importantly however, is the seat reinforcement unit which involves a pair of telescoping sleeve elements provided with slots wherein one of the sleeve elements is provided with a stop element and the other sleeve element is provided with a latch cam element which is pivoted by contact with the stop element to control the extension and retraction of the sleeve elements relative to one another during the extension and retraction of the collapsible desk and reinforced chair apparatus.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
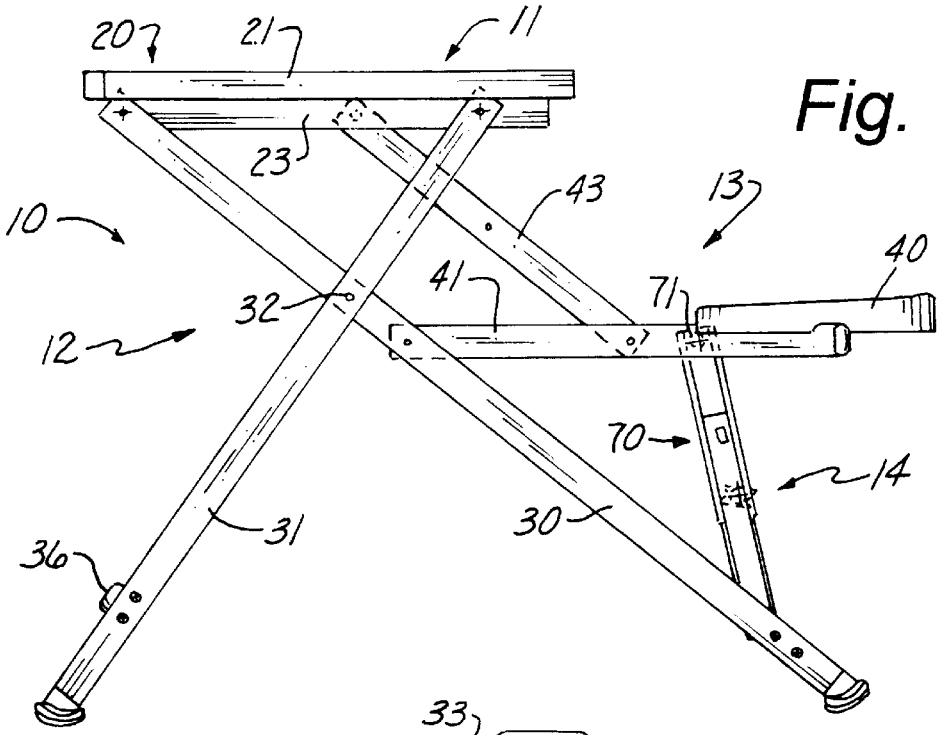
FIG. 1 is a side elevation view of the improved collapsible desk and chair apparatus that forms the basis of the present invention.

As can be seen by reference to the drawings, and in particularly to FIG. 1, the collapsible desk and chair apparatus that forms the basis of the present invention is designated generally by the reference number 10. The apparatus 10 comprises in general, a desk unit 11, a desk support unit 12, a seat unit 13, and a seat reinforcement unit 14. These units will now be described in seriatim fashion.

Figure 2:
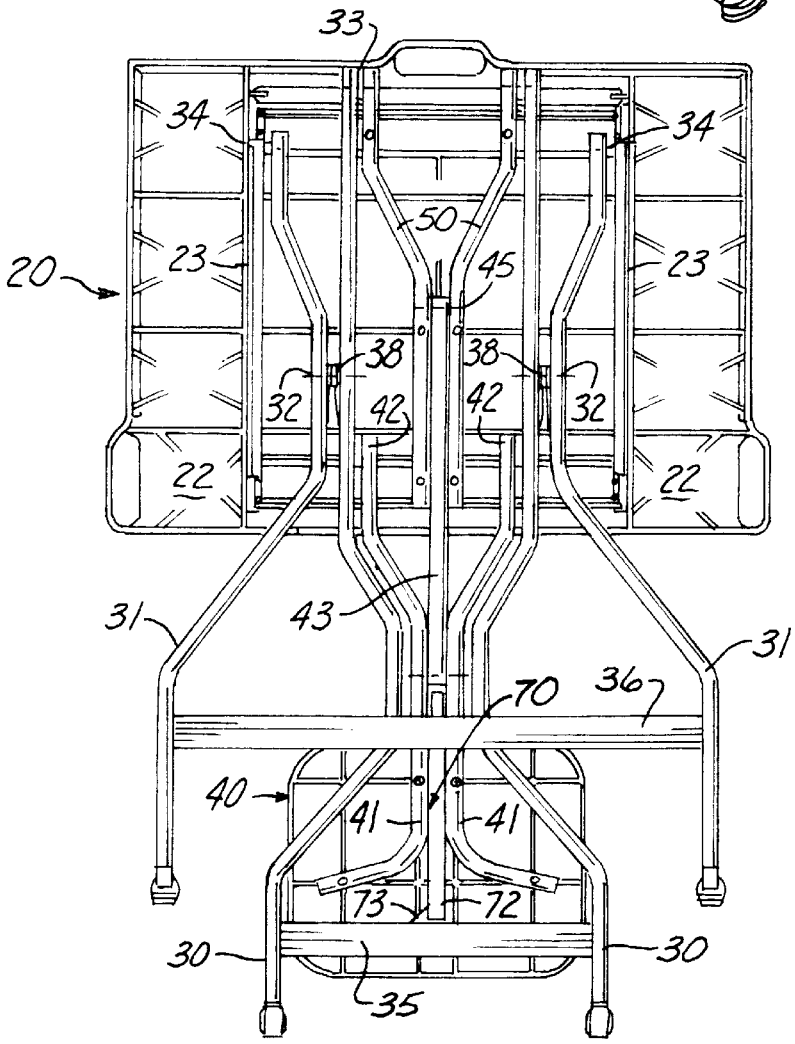
FIG. 2 is a bottom plan view of the collapsible desk and chair.

As shown in FIGS. 1 and 2, the desk unit 11 comprises an enlarged generally rectangular one-piece desk member 20 having a top surface 21, and a bottom surface 22 provided with a pair of elongated channel track elements 23 disposed in a parallel and spaced apart relationship relative to one another. The purpose and function of the channel track elements 23 will be explained presently.

As can best be seen by reference to FIG. 2, the desk support unit 12 comprises two pairs 30, 30 and 31, 31 of support legs that are operatively associated with the bottom surface 22 of the desk member 20 and pivotally secured to one another as at 32, 32 proximate their respective midpoints.

The first pair of support legs 30, 30 are pivotally and fixedly secured on their upper ends 33 to the bottom surface 22 of the desk member 20. The second pair of support legs 31, 31 are pivotally and moveably connected on their upper ends 34, 34 with in the channel track elements 23 for reasons that will be explained in greater detail further on in the specification.

As can be appreciated particularly by reference to FIG. 2, the first pair of support legs 30, 30 are substantially straighter and longer than the second pair of support legs 31, 31. The upper and intermediate portions of the support legs 30, 30 are relatively closely spaced and parallel to one another. The lower portion of the support legs 30, 30 are slightly outwardly flared and connected to one another by a relatively short cross-piece member 35.

Still referring to FIG. 2, it can be seen that the second pair of support legs 31, 31 have a contoured configuration including a slightly inwardly flared intermediate portion and a substantially outwardly flared lower portion wherein the lower portions of the support legs 31, 31 are connected to one another by an elongated contoured cross-piece member 36 having an outwardly bowed intermediate portion dimensioned to accommodate the lower portion of the first pair of support legs 30, 30 when the apparatus 10 is disposed in the collapsed mode.

Referring once again to FIGS. 1 and 2, it can be seen that the seat unit 13 comprises in general a seat member 40 provided with a pair of contoured seat support arms 41, 41 which are fixedly secured on their outboard ends to the seat member 40 and are pivotally secured on their inner ends as at 42, 42 to the intermediate portion of the first pair of support legs 30, 30.

In addition, the seat unit 13 further includes an angled brace element 43 which is pivotally secured on its lower end to the intermediate portions of the contoured seat support arms 41, 41 and which is pivotally secured on its upper ends as at 45 to the bottom surface 22 of the desk member 20.

At this juncture, it should be noted that in the preferred embodiment of the invention depicted in FIG. 2, both the pivoted connection of the upper end of the angled brace element 43 and the upper ends of the first pair of support legs 30, 30 are accomplished via an intermediary pair of contoured support arms 50, 50 which are rigidly secured to the bottom surface 22 of the desk member 20. Whereas, the intermediary pair of contoured support arms 50, 50 are provided primarily for the purpose of providing rigidity and support to the desk member 20. It is to be understood that individual conventional pivot support structures (not shown) could be substituted therefor, and still fall within the teachings of this invention.

It should further be noted by reference to FIG. 2, that the first 30, 30 and second 31, 31 pair of support legs are normally biased into their open disposition by a pair of spring elements 38 which are in operative contact with adjacent pair of support legs at their pivoted connection 32 to facilitate the transition of the apparatus 10 from the collapsed mode of FIG. 2 to the extended mode of FIG. 1.

As can best be seen by reference to FIGS. 1 and 2, the first pair of table support legs 30, 30 are substantially longer than the second pair of support legs 31, 31 for the simple reason that the seat unit 13 must be cantilevered out from the desk member 20 in its operative mode of disposition. Furthermore, while the upper ends of the first pair of table support legs 30, 30 are connected to the underside 22 of the desk member 20 in a straightforward pivoted fashion, the upper ends of the second pair of support legs 31, 31 are both pivotally and moveably disposed in the channel track elements 23 so that the second pair of support legs 31, 31 can be translated from the collapsed position of FIG. 2 to the extended position of FIG. 1.

Figure 3:
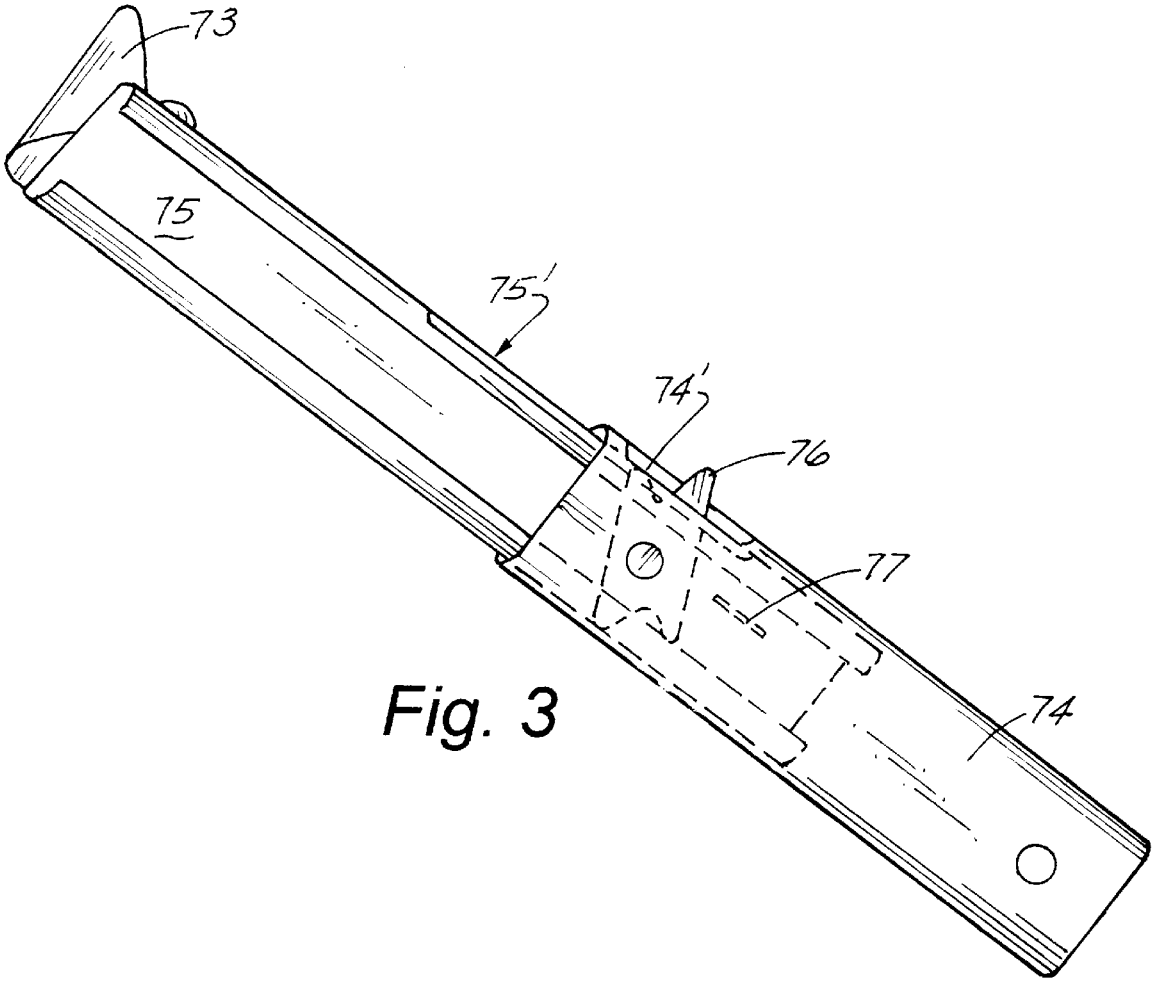
FIG. 3 is an isolated perspective view of the reinforcement unit.

As can best be seen by reference to FIGS. 1 through 3, the seat reinforcement unit 14 comprises a telescoping reinforcement member 70 pivotally connected on one end 71 to one of the contoured seat support arms 41 and pivotally connected on the other end 72 via a bracket 73 to the cross piece member 35 which is attached to the lower portion of the elongated pair of support legs 30, 30.

As shown in FIGS. 3 through 7, the telescoping reinforcement member 70 comprises a relatively short outer sleeve element 74 and an elongated inner sleeve element 75 wherein the outer sleeve element 74 is provided with a rotatable latch cam 76 disposed on one end and the inner sleeve element 75 is provided with a stop element 77 fixedly disposed on the opposite end.

In addition, the outer sleeve element 74 is provided with a relatively short slot 74' disposed opposite the latch cam 76 and the inner sleeve element 75 is provided with a relatively elongated slot 75' which originates below and extends rearwardly from one end of the stop element 77. The slots 74' and 75' are designed to overlap one another and interact with the latch cam 76 as will be explained presently.

Figure 8:
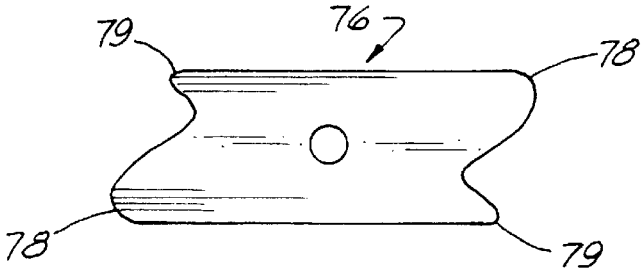
FIG. 8 is an isolated detail view of the cam member.

Prior to embarking on a description of the interaction between the slots 74', 75' and the latch cam 76, it would first be advisable to expand upon the construction and contour of the latch cam 76. As can best be seen by reference to FIG. 8, the latch cam 76 is provided with a generally flat top and bottom surface and contoured ends wherein each of the contoured ends are provided with an elongated projection 78 and a shortened projection 79 such that the elongated projections 78, 78 and the shortened projections 79, 79 are diametrically aligned relative to one another.

Turning now to FIGS. 4 through 7, it can be seen that the latch cam 76 assumes different orientations relative to the inner 75 and outer 74 sleeve elements during the extension and retraction phases of the desk and chair apparatus 10. During the initial extension phase and the final retraction phase of the apparatus 10 the latch cam 76 will assume the orientation depicted in FIG. 4.

Figures 4, 5, 6, 7:
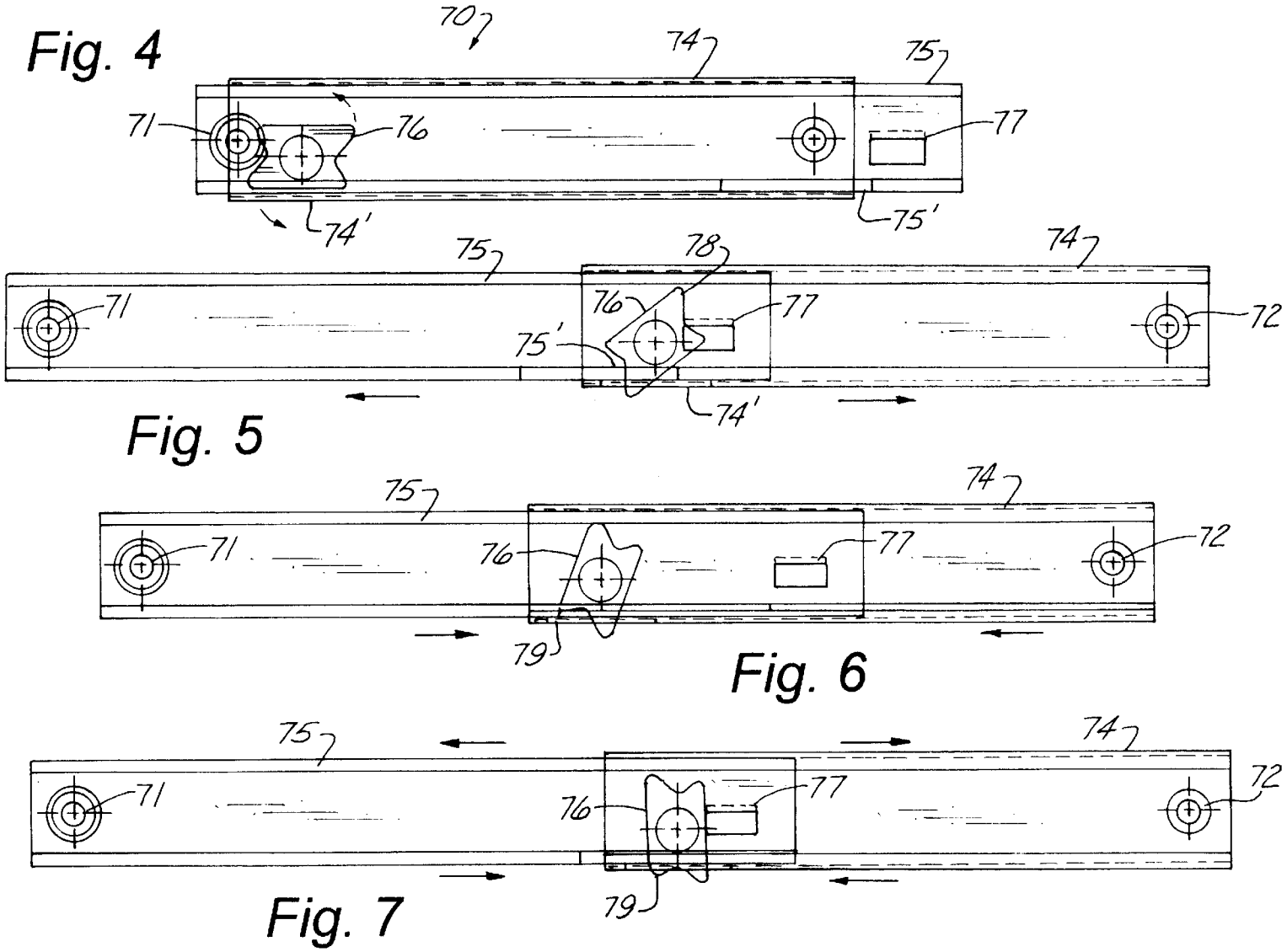
FIG. 4 is a cross sectional view of the cam member during the initial extension and final retraction phase of the reinforcement unit.
FIG. 5 is a cross-sectional view of the cam member when the reinforcement unit is fully extended during the operative deployment of the desk and chair apparatus.
FIG. 6 is a cross-sectional view of the cam member when the seat unit is locked in place relative to the elongated legs.
FIG. 7 is a cross-sectional view of the cam member being pivoted upwardly during the initial retraction phase.

As the inner 75 and outer 74 sleeve elements are withdrawn relative to one another as depicted in FIG. 5, the elongated projection 78 on the right side of the latch cam 76 will be engaged by the stop element 77 to rotate the latch cam 76 is the counter clockwise direction, which will force the elongated projection 78 on the left side of the latch cam 76 through the slots 74' and 75'.

Then as the inner and outer sleeve elements 75, 74 are moved towards one another as depicted in FIG. 6, the shortened projection on the lower, left side of the latch cam 76 will be brought into engagement with the interior of the inner sleeve element to prevent any further inward movement of the inner sleeve element 75 relative to the outer sleeve element 74 to provide a rigid support for the seat unit 13 when it is deployed in the configuration depicted in FIG. 1.

Now when the user wishes to collapse the apparatus 10 a downward movement applied to the cross-piece 36 will force the inner 75 and outer 74 sleeve elements apart as indicated by the directional arrows at the top of FIG. 7. The inner 75 and outer 74 sleeve elements will be extended relative to one another until the stop element 77 contacts the flat right side of the latch cam element 76 to incrementally rotate the latch cam element 76 in the counter clockwise direction to the vertical position shown in FIG. 7.

At this point, the continued application of downward force on the cross-piece 36 will cause the sleeve elements 74 and 75 to contract relative to one another. The inner sleeve element 75 will contact the left side of the latch cam element 76 in the counter clockwise direction to assume the position depicted in FIG. 4.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An improved collapsible desk and reinforced chair apparatus including:

a one piece desk member having a top surface and bottom surface;

a first pair of support legs pivotally secured to the bottom surface of the desk member at a fixed location;

a second pair of support legs pivotally secured to the bottom surface of the desk member at a moveable location; the first and second pair of support legs have intermediate portions which are pivotally secured to one another;

a seat unit pivotally associated with one of said pairs of support legs and the bottom surface of the desk member; and a seat reinforcement unit pivotally connected on one end to the seat unit and including a pair of telescoping sleeve elements wherein one of the sleeve elements is pivotally connected to the seat unit and the other sleeve element is pivotally associated with a portion of said first pair of support legs wherein one of the sleeve elements comprise an outer sleeve element provided with a rotating latch cam element disposed proximate one end and the other sleeve element comprises an inner sleeve element dimensioned to be slideably received in the outer sleeve element and provided with a stop element disposed proximate one end wherein the stop element is dimensioned to engage portions of said rotating latch cam element.

2. The apparatus as in claim 1 wherein the opposite ends of the rotating latch cam element are contoured and each end is provided with an elongated projection and a shortened projection.

3. The apparatus as in claim 2 wherein the elongated projections and the shortened projections on each end of the rotating latch cam element are diametrically disposed relative to one another.

4. The apparatus as in claim 2 wherein the outer sleeve element is provided with a relatively short slot disposed beneath and dimensioned to receive portions of the rotatable latch cam element.

5. The apparatus as in claim 4 wherein the inner sleeve element is provided with an elongated slot which extends rearwardly from and originates below and extends rearwardly from one end of said stop element.

6. The apparatus as in claim 5 wherein the stop element is adapted to engage and rotate the latch cam element to a position wherein a portion of one of the elongated projections extends through both of said slots and a portion of the adjacent shortened projection engages the inner sleeve element to limit the travel of the sleeve elements relative to one another in one direction.

* * * * *